US008359777B2

(12) United States Patent
Zajk

(10) Patent No.: US 8,359,777 B2
(45) Date of Patent: Jan. 29, 2013

(54) LIGHT WEIGHT FIRING CONTROL HOUSING FOR REVOLVER

(75) Inventor: Joseph J. Zajk, Newport, NH (US)

(73) Assignee: Sturm, Ruger & Company, Inc.

( * ) Notice: Subject to any disclaimer, the term of this patent is extended or adjusted under 35 U.S.C. 154(b) by 393 days.

(21) Appl. No.: 12/184,706

(22) Filed: Aug. 1, 2008

(65) Prior Publication Data

US 2009/0044436 A1 Feb. 19, 2009

Related U.S. Application Data

(60) Provisional application No. 60/955,723, filed on Aug. 14, 2007.

(51) Int. Cl.
*F41C 3/14* (2006.01)

(52) U.S. Cl. ..... 42/59

(58) Field of Classification Search ..... 42/54, 59, 42/62, 65

See application file for complete search history.

(56) References Cited

U.S. PATENT DOCUMENTS 115,483 A * 5/1871 Joslyn ..... 42/63
248,223 A * 10/1881 Smith ..... 42/63
422,930 A 3/1890 Fox et al.
465,179 A 12/1891 Johnson
678,274 A 7/1901 Owen
778,500 A * 12/1904 Mossberg ..... 42/65
955,436 A * 4/1910 Reid ..... 42/65
970,248 A * 9/1910 Lisle ..... 42/59
3,221,433 A * 12/1965 Lewis ..... 42/62
3,237,336 A * 3/1966 Lewis ..... 42/59
3,367,053 A * 2/1968 Lewis ..... 42/59
3,810,326 A * 5/1974 Hillberg et al. ..... 42/59
3,918,189 A 11/1975 Hartog
4,067,131 A 1/1978 Ruger et al.
4,437,250 A * 3/1984 Beretta ..... 42/59
4,621,445 A 11/1986 Rohm
4,833,810 A 5/1989 Domian
4,918,850 A 4/1990 Rick
5,293,708 A 3/1994 Strayer et al.
5,483,766 A 1/1996 Hochstrate et al.
5,622,160 A 4/1997 Casas Salva
6,357,157 B1 * 3/2002 Constant et al. ..... 42/84
6,574,898 B2 6/2003 Spencer et al.
6,928,763 B2 8/2005 Zajk

OTHER PUBLICATIONS

Modern Firearms—Handguns—MP412 "REX" [online], Copyright 1999-2004.Internet: <URL: http://web.archive.org/web/20040813192555/http://world.guns.ru/handguns/hg49-e.htm>.
Corresponding European patent Application No. 08797397.0-1260 / 2185888 PCT/US2008072506 extended European search report of Jan. 28, 2011.
Corresponding Taiwan patent Application No. 097131016 Office Action of Aug. 18, 2011 and translation.

* cited by examiner

*Primary Examiner* — Bret Hayes
*Assistant Examiner* — Reginald Tillman, Jr.
(74) *Attorney, Agent, or Firm* — The Belles Group, P.C.; Frank J. Spanitz, Esq.

(57) ABSTRACT

A revolver with light-weight firing control housing includes a cylinder frame supporting a rotatable cylinder defining a plurality of cartridge-receiving chambers and a firing control housing made of a non-metallic material. The firing control housing attaches to the cylinder frame and supports firing control mechanism components, such as a trigger and a pivotable hammer actuated by the trigger. In one embodiment, the firing control housing may be made of a polymer and the cylinder frame may be metal.

32 Claims, 11 Drawing Sheets

LIGHT WEIGHT FIRING CONTROL HOUSING FOR REVOLVER

CROSS-REFERENCE TO RELATED APPLICATIONS

The present application claims priority to U.S. Provisional Application No. 60/955,723 filed Aug. 14, 2007, which is incorporated herein by reference in its entirety.

BACKGROUND OF THE INVENTION

The present invention generally relates to firearms, and more particularly to a revolver with a separate firing control housing and cylinder frame.

Revolvers typically include a cylinder frame which rotatably supports a revolving cylinder with a plurality of chambers for holding cartridges and a grip frame that provides a structure for mounting and supporting a hand grip attached thereto at the rear of the revolver. The barrel of the revolver is also mounted to the front of or forms part of the cylinder frame.

In some designs such as heavy duty revolvers capable of firing magnum-type loads, a strong one-piece integral frame construction is often preferred which combines both the cylinder and grip frames into one integral unit for added durability needed to sustain the shock loads and recoil resulting from firing such high-caliber revolvers. U.S. Pat. No. 6,574,898 shows a typical one-piece revolver frame. Other known designs such as the revolver shown in U.S. Pat. No. 6,928,763 utilize a two-piece frame construction in which a separate structurally light and relatively thin grip frame is attached to the more robust cylinder frame which absorbs the bulk of the recoil forces. In such two-piece designs, the grip frame provides not much more than a narrow skeletal framework for mounting a hand grip thereto. The firing control mechanism components including the hammer, trigger, pawl, and related parts are mounted together in a firing control housing that typically is formed as an integral part of the substantially heavier cylinder frame. The firing control housing is typically located in the rear of the cylinder frame since these components operably interact with and therefore must be located proximate to the rear of the cylinder for striking a chambered cartridge. In practice, it is difficult to achieve proper alignment and meshing between the trigger and hammer operably coupled thereto if these firing control components were mounted in separate frames. To withstand the shock and stresses associated with firing the revolver, the cylinder frame including the firing control housing have traditionally been made of metal such as steel or aluminum.

Reducing the weight of the component support structures for firearms and therefore the overall weight is desirable for making the firearm easier for a user to carry. This is especially true for compact concealed-carry firearms where weight is an important consideration. However, both cylinder and sometimes separate grip frames used heretofore for revolvers have traditionally been made completely of metal. This is largely because the firing control components were mounted in the firing control housing portion of the cylinder frame, which necessarily is made of metal. Because the metal cylinder frame is far heavier than the grip frame even in two-piece revolver frame constructions, there was little weight savings possible by simply making the grip frame of a lighter material. Although semi-automatic pistols have used non-metallic polymer grip frames in combination with metal reciprocating slides mounted thereon, the concept of using dual materials in revolvers has not been used heretofore because of the limited potential gains in weight reduction achievable using the foregoing conventional revolver construction with mounting the firing control components in the cylinder frame. Previous use of non-metallic materials such as polymers in revolvers has been largely limited to the non-structural handgrips which typically are attached to the metal grip frame via threaded fasteners.

Accordingly, an improved revolver component support structure and firing control arrangement is desired.

SUMMARY OF THE INVENTION

In one embodiment, a revolver is provided that includes a cylinder frame for rotatably carrying the cylinder and a separate firing control housing for mounting and supporting the firing control mechanism components operably associated with the cylinder for discharging the revolver. In one embodiment, the cylinder frame is made of metal while the firing control housing preferably is made of a light-weight non-metallic material, and more preferably in one embodiment is made of a polymer possessing a combination of high strength and toughness. In one embodiment, the rear of the firing control housing includes an elongated rear grip tang for mounting a hand grip thereto.

Advantageously, in contrast to aluminum which is sometimes used for revolver frames, a polymer-based firing control housing frame for example according to the preferred embodiment has approximately equal strength to some aluminum alloys with only approximately half of the weight. Furthermore, since the firing control housing is not part of the heavier metal cylinder frame as in known revolver designs, the length of the cylinder frame can be truncated and shortened to allow more of the component support structure to be made from the lighter weight non-metallic material. The preferred embodiment therefore offers a revolver in the same overall unit size to the user at a significantly reduced total weight compared with known all metal revolvers. In addition, a contrasting and/or textured non-metallic firing control housing such as one made of a dark or otherwise colored polymer provides an aesthetically interesting and pleasing appearance to many users not seen heretofore in all metal frame revolver designs having a substantially uniform appearance in color and texture.

According to another embodiment, a solid-frame revolver with lateral or side swing-out cylinder is provided that includes a cylinder latching system or mechanism for locking the pivotally movable cylinder into a supportive cylinder frame. Such revolver designs typically include a cylinder swing arm or crane to pivotally mount the cylinder to the cylinder frame for loading cartridges into or removing spent cartridge casings from the cylinder. In one embodiment, a cylinder latching mechanism for a revolver includes a cylinder rotatably mounted in a frame and a spring-loaded plunger engageable with the cylinder or a component operably associated with the cylinder, such as without limitation an ejector in one embodiment. The plunger is moveable from a locked position to an unlocked position to release the cylinder. In a preferred embodiment, the plunger may be slidably disposed in a cavity in the cylinder frame and retained therein by a retaining plug locked into the frame by an interference fit between a barrel insert and the retaining plug.

BRIEF DESCRIPTION OF THE DRAWINGS

The features of the preferred embodiments will be described with reference to the following drawings where like elements are labeled similarly, and in which.

DESCRIPTION OF PREFERRED EMBODIMENTS

Figure 1:
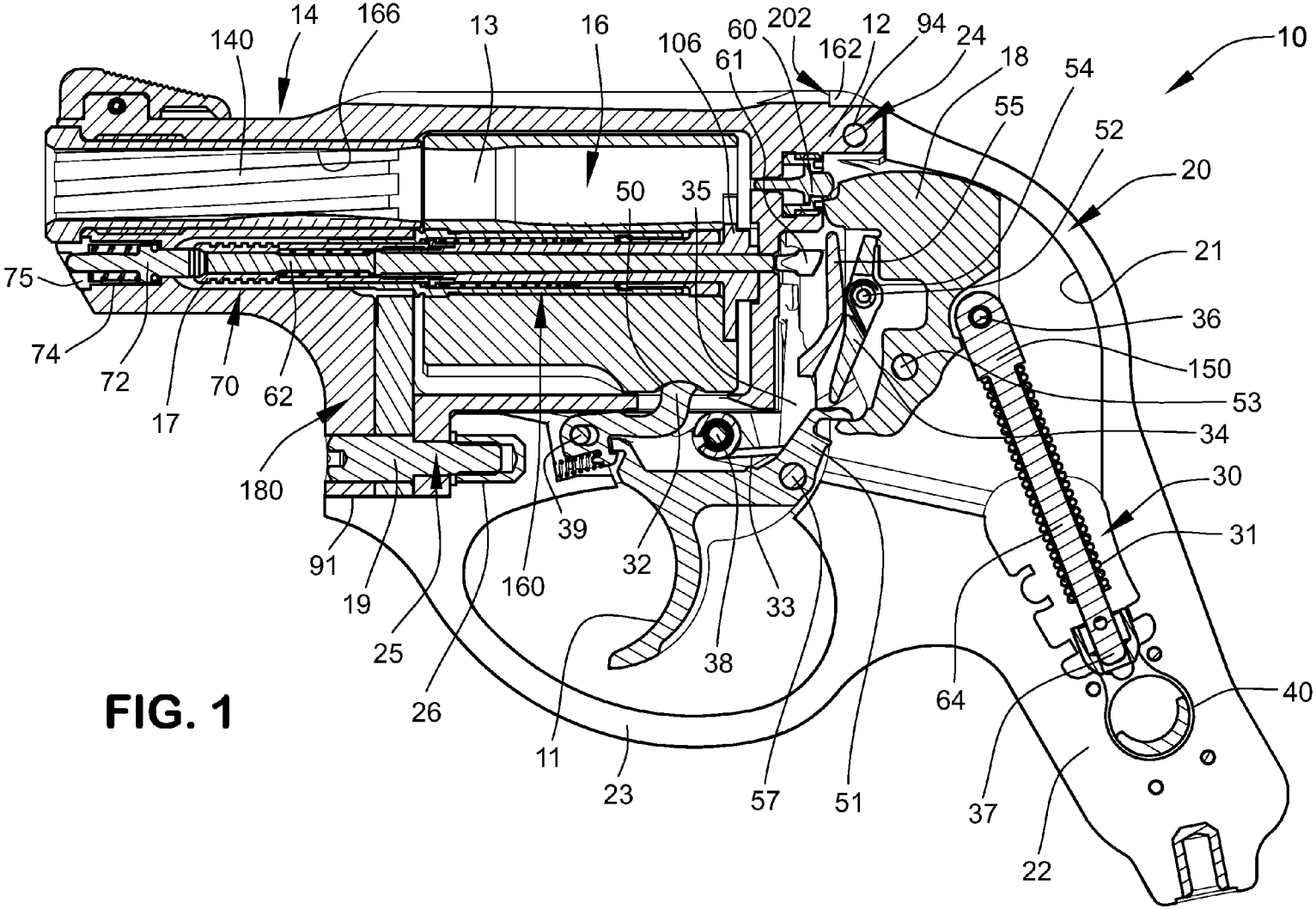
FIG. 1 is a left side cross-sectional view of one embodiment of a revolver with a separate firing control housing.

The features and benefits of the invention are illustrated and described herein by reference to preferred embodiments. This description of preferred embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected" and "interconnected," refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

Referring to FIG. 1, a revolver 10 in the form of a double-action solid-frame revolver is shown as including a cylinder frame 12 with cylinder 16 rotatably carried by frame 12 and defining a plurality of chambers 13 formed inside therein for holding cartridges. Cylinder 16 is supported by a cylinder crane 180 including an upper support tube 101 received through the hub of the cylinder and a lower retaining pin 19 removably received through aperture 56 of the crane. Cylinder crane 180 is used to pivot cylinder 16 outwards from cylinder frame 12 from a ready-to-fire position wherein the cylinder is positioned in the frame and a chamber 13 may be aligned with barrel 14, to a lateral loading position for loading cartridges into chambers 13 wherein the cylinder is laterally displaced from the frame. Revolver 10 further includes barrel 14 extending forward from cylinder frame 12 and defining an internal bore 166 for receiving a bullet. In a preferred embodiment, barrel 14 includes a barrel insert 140 which is a separate component that is removably received in barrel mounting bore 79 of cylinder frame 12 (best shown in FIGS. 7 and 8) and supported by the frame as shown herein. In other embodiments, the barrel may be formed as an integral part of cylinder frame 12 (not shown). Preferably, barrel insert 140 is made of tough metal such as steel that is capable of withstanding deflagration pressures from discharging revolver 10 and capable of withstanding the wear caused by the heat and friction of the bullet as it travels through the internal bore 166. In a preferred embodiment, cylinder frame 12 is preferably made of metal, and more preferably may be aluminum, titanium, or steel.

Figure 2:
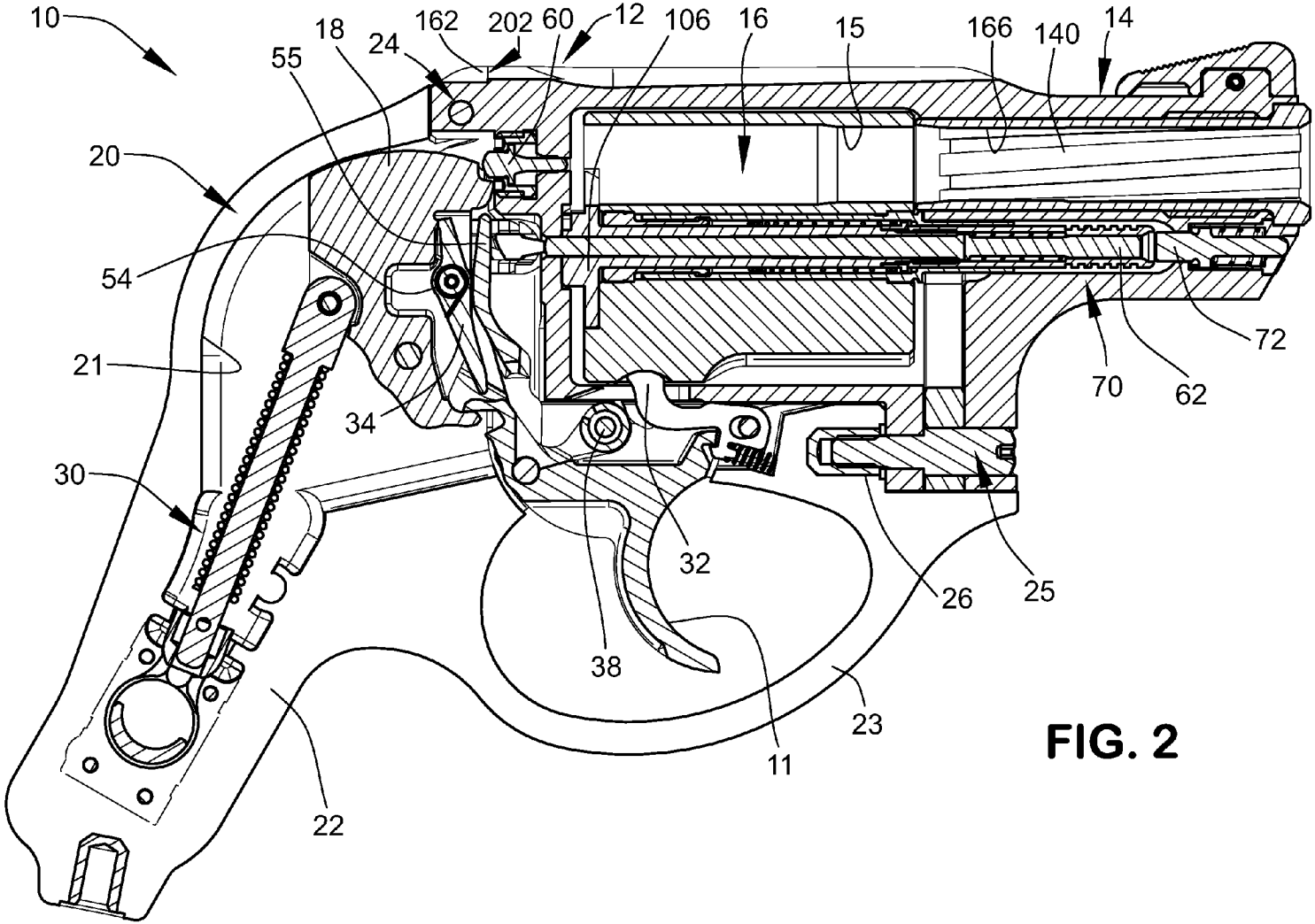
FIG. 2 is a right side cross-sectional view of the revolver of FIG. 1.
Figure 7:
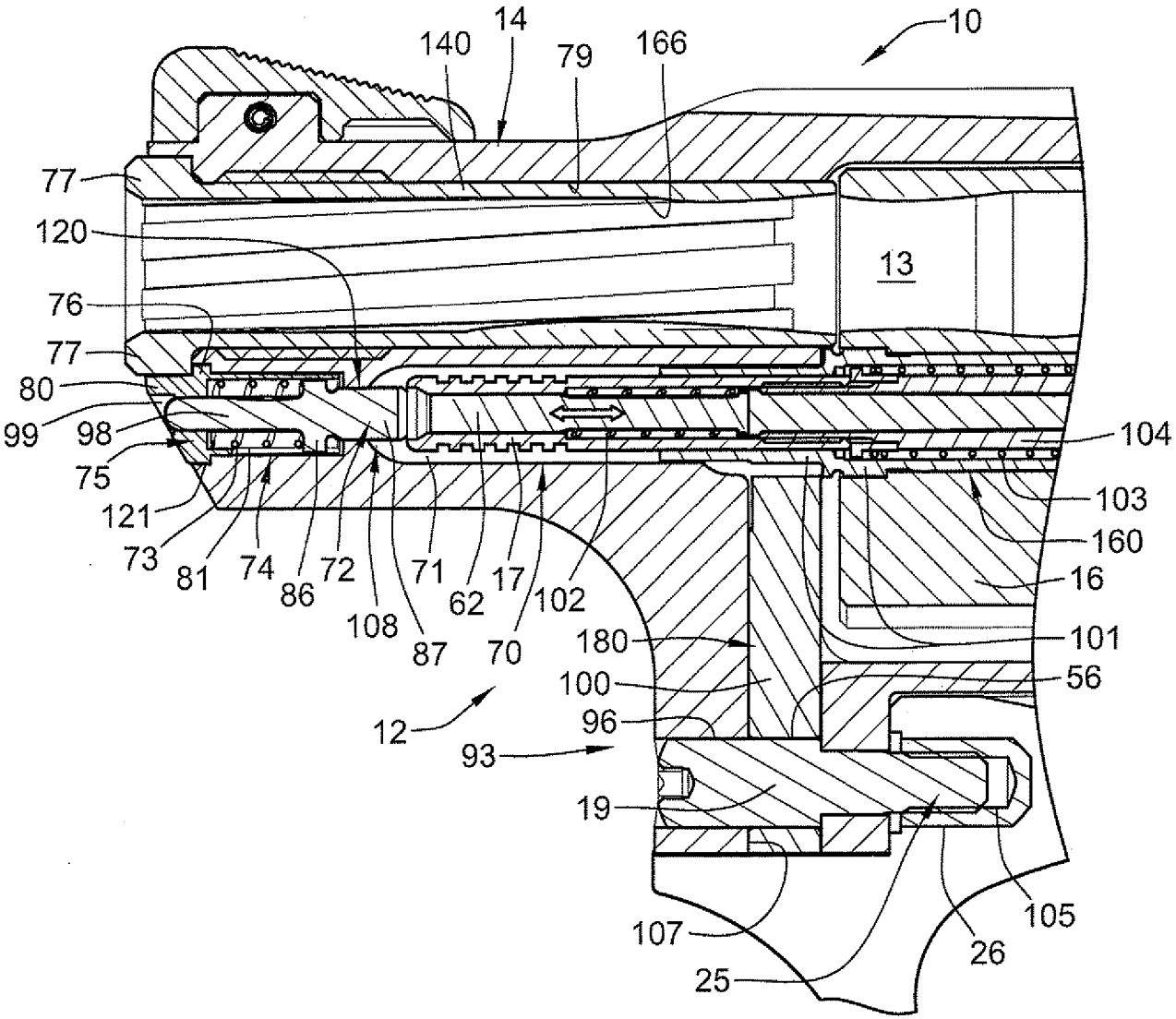
FIG. 7 is a close-up cross-sectional side view of the barrel portion of the revolver of FIG. 1.

With continuing reference to FIGS. 1, 2, and 7, revolver 10 further includes a spring-loaded ejector 106 for ejecting spent cartridge casings from the revolver. Ejector 106 is disposed at the rear of cylinder 16 and is configured to operably engage the rim of a cartridge when disposed in each cylinder 13. An ejector rod 104 having a passageway disposed therethrough is coupled to ejector 106 and extends axially forward through cylinder 16. Ejector spring 103 biases ejector rod 104 forward and may be depressed by a user to ejector spent casing from revolver 10 in a conventional manner. In a preferred embodiment, ejector rod 104 preferably includes a forward-extending ejector rod extension 17 which is configured to engage an end cap 71 disposed thereon. Preferably, at least a portion of ejector rod extension 17 is externally threaded to engage complementary-configured internal threads on end cap 71, further described herein.

With reference to FIGS. 1 and 2, revolver 10 further includes a separate firing control housing 20 attached to the rear of cylinder frame 12 for mounting and housing the firing control components used to discharge and operate the revolver. In one embodiment, firing control housing 20 is removably attachable to cylinder frame 12. In one embodiment, the rear of firing control housing 20 includes an elongated rear grip tang 22 for supporting and mounting a one-piece or two-piece hand grip (not shown) thereto. In one possible embodiment as shown, firing control housing 20 preferably may include a forward extending portion defining an integral trigger guard 23. In other embodiments, trigger guard 23 may be a separate component that attaches to firing control housing 20 and/or cylinder frame 12.

Preferably, firing control housing 20 may be made of a light-weight non-metallic material, and more preferably in one embodiment may be made from a polymer. In a preferred embodiment, firing control housing 20 is made of a composite material such as a fiber-reinforced polymer for added strength and toughness to withstand the forces of firing revolver 10. Some typical suitable and durable polymers that may be used without limitation are fiber-reinforced nylons and urethanes. Any suitable non-metallic light-weight material may be used so long as it has sufficient strength and toughness to withstand forces generated from firing revolver 10. In a preferred embodiment, firing control housing 20 is made by a molding process. Advantageously, in contrast to using metals, fabricating firing control housing 20 from a polymer via molding processes allows complex and intricate shapes and openings to be economically created and which are needed to incorporate the various firing control mechanism and other components. Moreover, such intricate shapes and openings either cannot technically be produced in metals or require extensive machining steps which are cost prohibitive.

It will be appreciated that although firing control housing 20 is shown in application to a double-action revolver with an internal hammer 18, the invention may also be used with equal benefit for single-action and double-action revolvers having either internal hammers or hammers with an exposed spur that is manually cockable by a user. Accordingly, the invention is not limited to double action and/or internal spurless hammer revolver designs as illustrated by the preferred embodiment herein.

It will be appreciated that while a fiber reinforced polymer is the preferred material for the firing control housing, certain revolver cartridges generate very high firing pressures and resulting forces on the revolver frame. These may exceed the strength of the polymer fire control housing. Therefore, the invention is not limited to polymers but may include metals such as aluminum, titanium, or steel.

Fabricating firing control housing 20 from non-metallic materials such as polymers offers numerous possibilities for creating an aesthetically interesting and pleasing overall ornamental appearance for revolver 10 not available in many conventional revolver designs. For example, as best shown in FIG. 2, preferably non-metallic cylinder firing control housing 20 may be made darker in color than contrasting metallic cylinder frame 12. Thus, in some possible embodiments, firing control housing 20 may be dark grey or black in color. In other possible embodiments, however, the metallic cylinder frame may be darker (e.g. blued or blackened) whereas the firing control housing may be made of a contrasting lighter color in non-metallic material. In addition, in some embodiments, firing control housing 20 may have various surface textures such as graining, pebbling, dimples, etc. Accordingly, numerous ornamental color and texture combinations are advantageously possible for revolver 10 as a result of using non-metallic materials for firing control housing 20.

Firing control housing 20 may be mounted to cylinder frame 12 in any suitable manner. In one possible embodiment as shown in FIGS. 1, 6, 7, and 11, firing control housing 20 may be mounted to cylinder frame 12 via an upper pinned connection 24 located generally behind cylinder 16 and a forward lower pinned connection 25 above trigger guard 23. In a preferred embodiment, upper pinned connection 24 may be formed by pin 94 received through two spaced-apart holes 92 in a pair of projections 162 extending from firing control housing 20 and a single hole 90 in a projection 164 on preferably cylinder frame 12 as shown. Since firing control housing 20 is preferably made of a non-metallic material such as polymer in a preferred embodiment while cylinder frame 12 is made of metal, the added bearing surface 200 provided by two projections 162 on the weaker polymeric housing 20 provides a strong connection to absorb the recoil forces from discharging revolver 10 which are distributed over a pair of polymeric projections defining holes 92.

Figure 11:
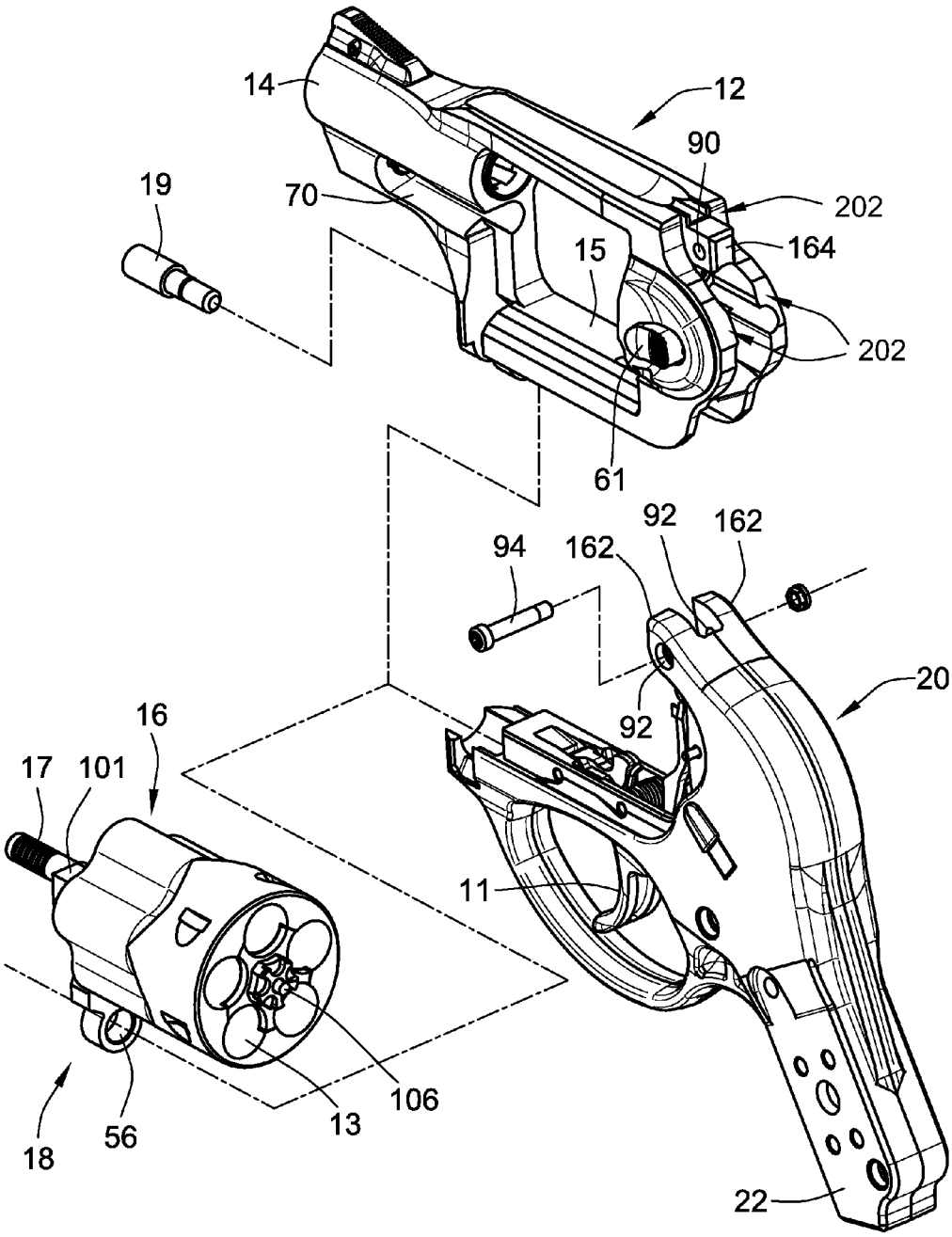
FIG. 11 is an exploded rear perspective view of the revolver of FIG. 1.

As shown in FIGS. 4-6 and 10, bearing surfaces 200 defined by each projection 162 on firing control housing 20 may continue and extend downwards forming a spaced pair of vertically extending continuous bearing surfaces. Bearing surfaces 200 mate with and engage a pair of complementary configured bearing surfaces 202 defined on the rear of cylinder frame 12 on opposite sides of rear projection 164 as shown in FIG. 11. In one embodiment as shown, bearing surfaces 200 located below projections 162 may include a generally concave shaped portion and bearing surfaces 202 may include a complementary mating convex shaped portion wherein the mating bearing surfaces mesh together when the cylinder frame 12 is assembled to firing control housing 20 (see, e.g. exploded assembly views in FIGS. 6 and 11). FIGS. 1 and 2 show the uppermost portions of each bearing surface 202 on cylinder frame 12 engaged with the uppermost portions of each bearing surface 200 on projections 162 of the firing control housing 20 when the cylinder frame is assembled to firing control housing.

In one embodiment, lower pinned connection 25 for mounting firing control housing 20 to cylinder frame 12 may be formed by a threaded hole 26 disposed in firing control housing 20 which receives lower retaining pin 19 operably associated with forming a pivot for cylinder crane 180. In one embodiment, pin 19 includes a shaft having at least a portion being threaded to engage complementary-shaped threads in hole 26. In a preferred embodiment where firing control housing 20 is made of a non-metallic material and pin 19 is metallic, a metallic threaded insert 105 (best shown in FIG. 7) configured to threadably engage pin 19 may be disposed in firing control housing hole 26 to prevent stripping of threads in the generally softer non-metallic housing. In a preferred embodiment, retaining pin 19 may have a head at one end configured to be engaged by a tool such as a slotted, Phillips, or other shaped screwdriver for securing pin 19 to firing control housing 20.

Figure 6:
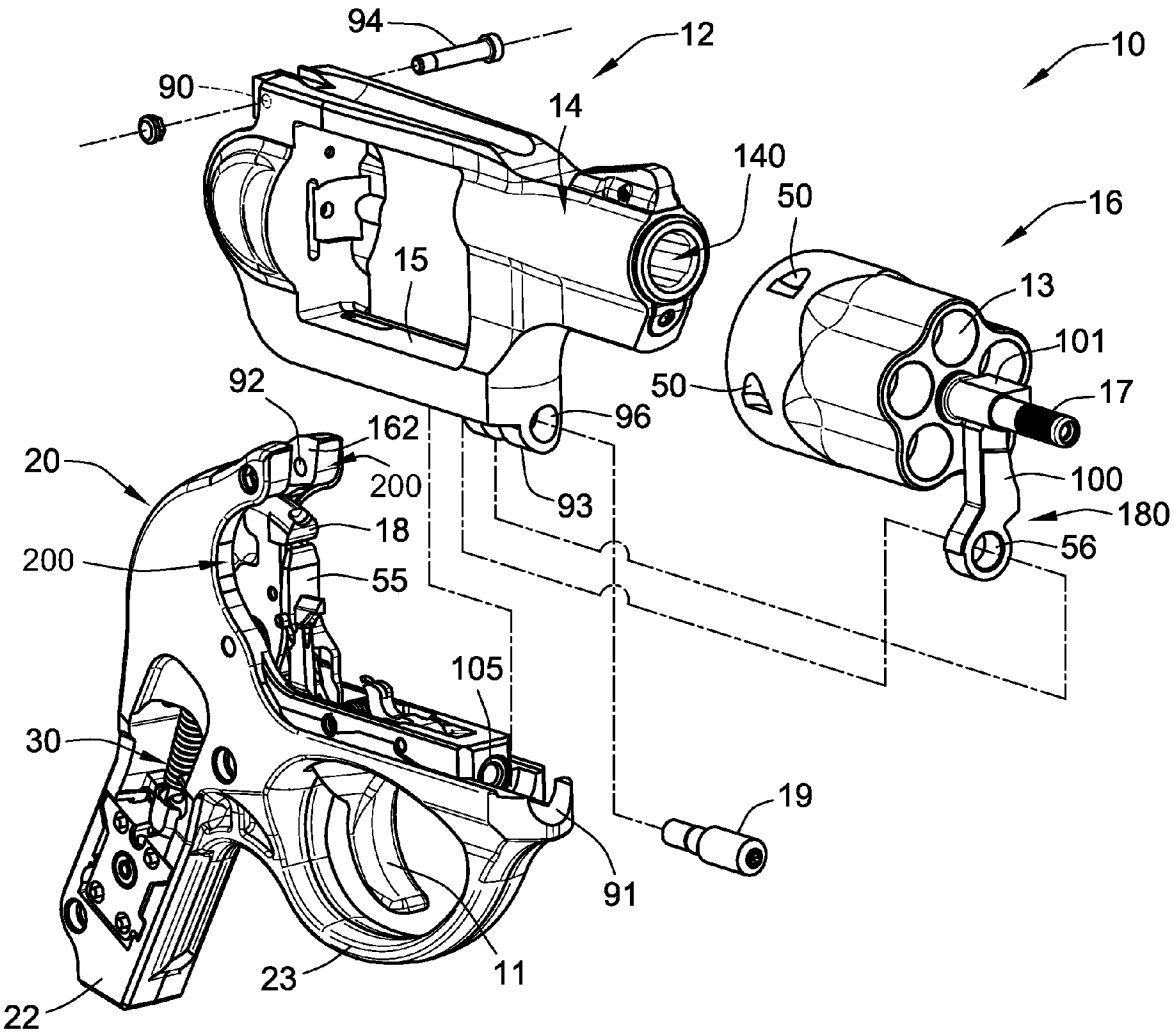
FIG. 6 is an exploded front perspective view of the revolver of FIG. 1.

With continuing reference to FIGS. 1, 6, and 7, retaining pin 19 in one embodiment may be received through a pair of spaced-apart holes 96 defined in a lobed portion 93 formed near the bottom forward section of cylinder frame 12 (see FIGS. 6 and 7). Lobed portion 93 further defines a recess 107 disposed between holes 96 which is configured to receive the lower portion of cylinder crane swing arts 100 with aperture 56. In one embodiment, lobed portion 93 of cylinder frame 12 is received in a complementary-shaped recess 91 formed on a forward portion of firing control housing 20 as best shown in FIGS. 6 and 7. When lobed portion 93 is seated in recess 91 of cylinder frame 12, holes 96 in lobed portion 93, aperture 56 in swing arm 100, and threaded hole 26 in cylinder frame 12 preferably become concentrically aligned so that retaining pin 19 may be inserted therethrough to couple the cylinder frame 12 and cylinder crane 180 to the front of firing control housing 20. Retaining pin 19 is threaded into hole 26 or metallic insert 105 to secure the cylinder frame 12 and firing control housing 20 together.

It will be appreciated that the foregoing lower pinned connection 25 construction with retaining pin 19 provides a robust attachment of the cylinder frame to the preferably lighter-weight, non-metallic firing control housing that is capable of withstanding recoil forces generated by discharging revolver 10. Unlike the use of polymer grip frames in semi-automatic pistols which have reciprocating slides and recoil springs to absorb the recoil forces, all of the recoil forces generated by revolvers are absorbed by the historically metal cylinder frame and metal grip frames, both of which traditionally have been made of steel and/or aluminum. Therefore, pinned attachment of the metal-to-metal frame components of conventional revolvers using relatively small metal pins and fasteners have heretofore been relied upon to prevent separation of the cylinder frames and grip frames due to recoil forces. This traditional type of mounting technique would lack sufficient strength and be generally unsuitable for coupling a metal cylinder frame to non-metallic firing control housing or similar structure, particularly for the front mount which experiences the highest bending stresses when discharging a revolver. The robust mounting arrangement provided herein provides a secure mount capable of withstanding the recoil forces and stress associated with recoil making the use of light-weight, non-metallic firing control housings possible.

FIG. 6 shows an exploded perspective view of revolver 10. Cylinder frame 12 defines an opening 15 which receives cylinder 16. In contrast to conventional larger and heavier metal cylinder frames, the truncated length and reduced size of the metal cylinder frame 12 is made possible by mounting the firing control components in a separate preferably non-metallic and lighter-weight firing control housing 20 (see, e.g. FIGS. 3 and 4). In a preferred embodiment, firing control housing 20 is made of a polymer and includes grip tang 22 to further reduce weight.

Figure 3:
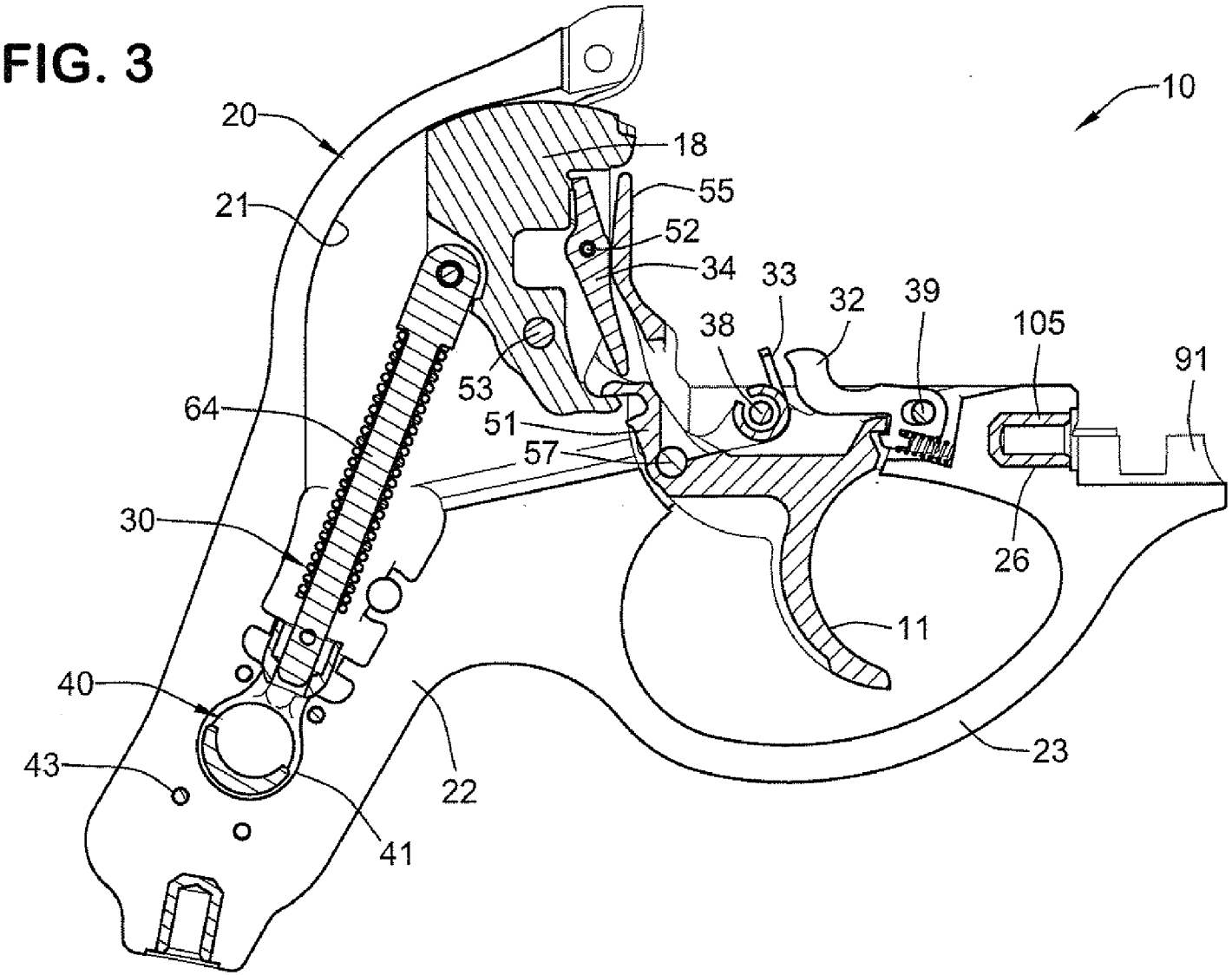
FIG. 3 is a right side cross-sectional view of the firing control housing of the revolver of FIG. 1 with firing control components mounted therein.
Figure 4:
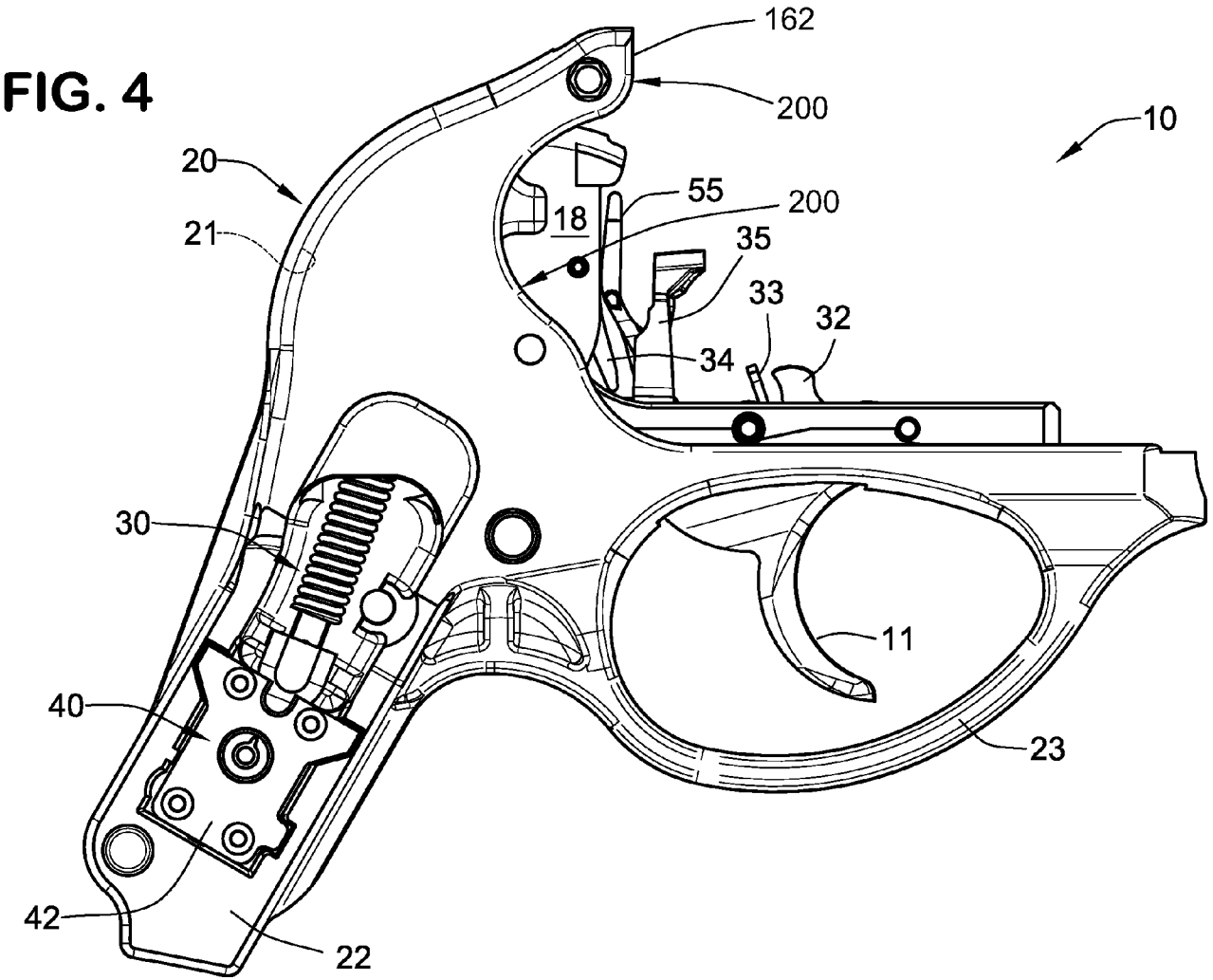
FIG. 4 is a right side view of the firing control housing of the revolver of FIG. 1 with firing control components mounted therein.
Figure 5:
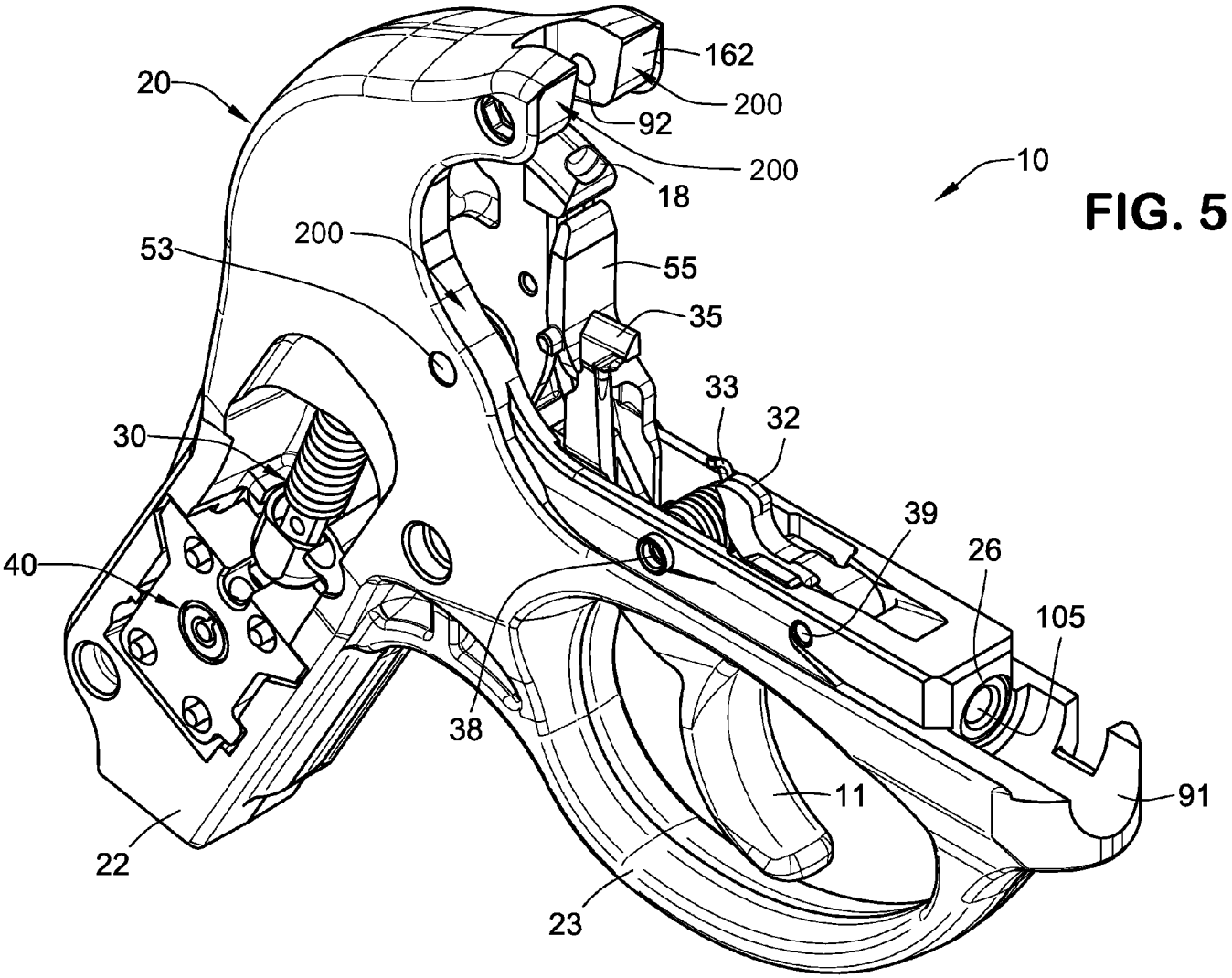
FIG. 5 is a right side perspective view of the firing control housing of the revolver of FIG. 1 with firing control components mounted therein.

FIGS. 3-5 show various right side views of the firing control housing 20 with the firing control components supported and mounted therein. As shown in FIG. 3, in one embodiment grip tang 22 is configured to define an opening 41 for receiving an optional rotary mainspring lock 40 and its associated lock housing 42 (shown in FIG. 4) mounted to the grip tang using pins inserted in holes 43. The rotary lock 40 interacts with hammer strut 64 to disable the firing control mechanism.

Referring now primarily to FIGS. 1-5 and 10, revolver 10 in a preferred embodiment includes a firing control mechanism completely supported by firing control housing 20 that is independent of the cylinder frame 12, and which mechanism generally includes the following firing control components: trigger 11, hammer 18, cylinder lock 32, hammer lever or dog 34, pawl 35, and mainspring assembly 30 with mainspring 31. In one embodiment, mainspring assembly 30 includes mainspring strut 64 having an upper end 150 pinned connection to pin 36 of hammer 18 and a lower end 37 braced against a portion of grip tang 22. In one embodiment shown in the figures, lower end 37 of strut 64 may be engaged with a rotary lock 40 that may be provided and disposed in grip tang 22. Hammer dog 34 is essentially a spring-biased lever that is pivotably mounted to hammer 18 about a pinned connection 52 and is operably positioned between trigger 11 and hammer 18. Hammer dog 34 is biased upwards (clockwise in FIG. 1) by a spring 54 (see FIG. 2) towards hammer 18 and is engageable by the rear of trigger 11. Hammer dog 34 is rotated upwards in response to a trigger pull to fully cock and then release hammer 18 forward for discharging revolver 10 in a conventional double action operating mode. When released, trigger 11 then returns downward and forward after firing to the position shown in FIG. 1.

Hammer 18 is pivotably mounted to firing control housing 20 about a pinned connection 53 and is movable in rearward and forward arcuate motions. Hammer 18 is biased forward towards the cylinder by mainspring 31 as noted above. As shown in the preferred embodiment, hammer 18 is completely internal and movably disposed in cavity 21 of firing control housing 20. In one embodiment, the upper portion hammer 18 may have a rounded or arcuate profile and upper surface as shown that complements a corresponding arcuate inner profile of cavity 21. Since firing control housing 20 is advantageously completely enclosed in the preferred embodiment, foreign debris cannot enter cavity 21 and contaminate the firing mechanism unlike some conventional housing designs which sometimes have an upper opening even when spurless hammers are used. Advantageously, the use of non-metallic materials such as molded polymers for firing control housing 20 makes fabrication of intricate details and curved contours possible and more economical than fabricating comparable metal housings which may require separate and additional machining steps to create these features. In addition, raw production costs associated with molding polymers to form firing control housing as shown and described herein is advantageously significantly less than producing such a housing in metal. Moreover, it should be noted that the smooth, rounded top profile of firing control housing 20 is ideally suited for small concealed-carry revolvers since the revolver will not snag on a user's clothing when drawn. Although the preferred embodiment is an enclosed spurless hammer, the invention is not be limited to this design and may also include versions with an open slot for a protruding, spurred hammer that can be manually operated by the user.

With continued reference to FIGS. 1-5 and 10, trigger 11 is pivotably mounted to firing control housing 20 about a pinned connection 38 and moves arcuately in response to a trigger pull by a user. Trigger 11 is biased downwards and forward by trigger torsion spring 33. Cylinder lock 32 is mounted about pinned connection 39 to firing control housing 20 and is actuated by trigger 11. Cylinder lock 32 keeps one of the chambers 13 concentrically aligned with the bore of barrel insert 140 during firing. Cylinder lock 32 is preferably biased upwards by a spring (not shown) into engagement with a cylinder lock depression 50 formed in cylinder 16. Preferably, a cylinder lock depression 50 is provided for each chamber. When trigger 11 is pulled rearwards, a front portion of the trigger ahead of pinned connection 38 rotates downwards (counter-clockwise in FIG. 1) which engages and rotates cylinder lock 32 downwards in an opposite direction (clockwise in FIG. 1) about pin 39. This motion disengages cylinder lock 32 from one of the cylinder lock depressions 50 (see FIG. 1) so that cylinder 16 may be rotated by pawl 35 in a conventional manner to the next firing position in response to pulling the trigger 11. When trigger 11 reaches a predetermined rearward point and a cylinder 13 containing the next cartridge to be discharged aligns with barrel insert 140, cylinder lock 32 is released by the trigger and returns to its initially upward position to engage an new cylinder lock depression 50. Further rearward motion of hammer 18 releases the hammer to strike and detonate the cartridge directly or indirectly via an intermediate firing pin carried by the cylinder frame 12 positioned between the hammer and cartridge.

As described above, pulling trigger 11 also cocks and releases hammer 18 to discharge revolver 10. When trigger 11 is pulled, an extension arm 51 projecting rearwards from the trigger engages and rotates hammer dog 34 upwards (clockwise in FIG. 1) which in turn rotates hammer 18 rearwards (clockwise in FIG. 1) to a predetermined point where the hammer is then released to strike a cartridge in one of the chambers 13 or an intermediate firing pin disposed between the hammer and cartridge.

With continued reference to FIGS. 1-5 and 10, the firing control mechanism of revolver 10 may include a transfer bar 55 in some embodiments. Transfer bar 55 is vertically movable in response to a trigger pull and reduces the likelihood that the revolver will fire in the absence of a trigger pull. In one embodiment, transfer bar 55 may be positioned forward of hammer dog 34 and is movably coupled to trigger 11 via a pinned connection 57. Pawl 35 may also be movably coupled to trigger 11 via same pinned connection 57 or by a different connection. A spring-loaded firing pin 60 (shown in FIGS. 1 and 2 without the spring for clarity) is received in a recess formed in cylinder frame 12 and axially movable therein to strike a cartridge when loaded in chamber 13. When trigger 11 is pulled, transfer bar 55 moves vertically upwards in response and becomes positioned between hammer 18 and firing pin 60. As hammer 18 becomes fully cocked and is then released as described herein, the hammer strikes transfer bar 55 which in turn transfers the force to firing pin 60 propelling the firing pin forward to strike a cartridge. In the absence of a trigger pull, hammer 18 preferably is incapable of reaching firing pin 60 when the hammer is in its forward-most position.

With reference to FIGS. 1-2, 6, and particularly FIG. 7, cylinder crane 180 includes an upper support tube 101 that includes a rearward-extending cylindrical portion received in the hub 160 of the cylinder 16 and a forward-extending portion that in one embodiment is received in a complementary shaped recess 70 in the forward portion of cylinder frame 12. In one embodiment best shown in FIG. 6, the forward-extending portion of support tube 101 need not be completely cylindrical in shape since it is disposed in cylinder frame 12 and not the cylindrically-shaped cylinder hub. Support tube 101 rotatably supports cylinder 16 in cylinder frame 12. In a preferred embodiment, upper support tube 101 preferably is hollow to axially slidably receive center pin rod 62 and ejector rod 104 received at least partially in tube 101. Cylinder center pin rod 62 is biased rearward by spring 102 (best shown in FIG. 7) and axially movable being actuated by a cylinder release latch 61 (shown in FIG. 10). Center pin rod 62 allows a user to disengage ejector rod extension 17 from cylinder frame 12 and pivot cylinder 16 laterally outwards from the cylinder frame 12 as further described herein to load cartridges into or eject spent casings from cylinder chambers 13 using ejector 106.

In one possible embodiment, upper support tube 101 is disposed on top of crane swing arm 100 (best shown in FIG. 6). Support tube 101 may be formed as an integral part of swing arm 100 or may be a separate component attached thereto in other embodiments. Aperture 56 is defined by a lower portion of swing arm 100 to receive crane retaining pin 19 therein.

Figure 8:
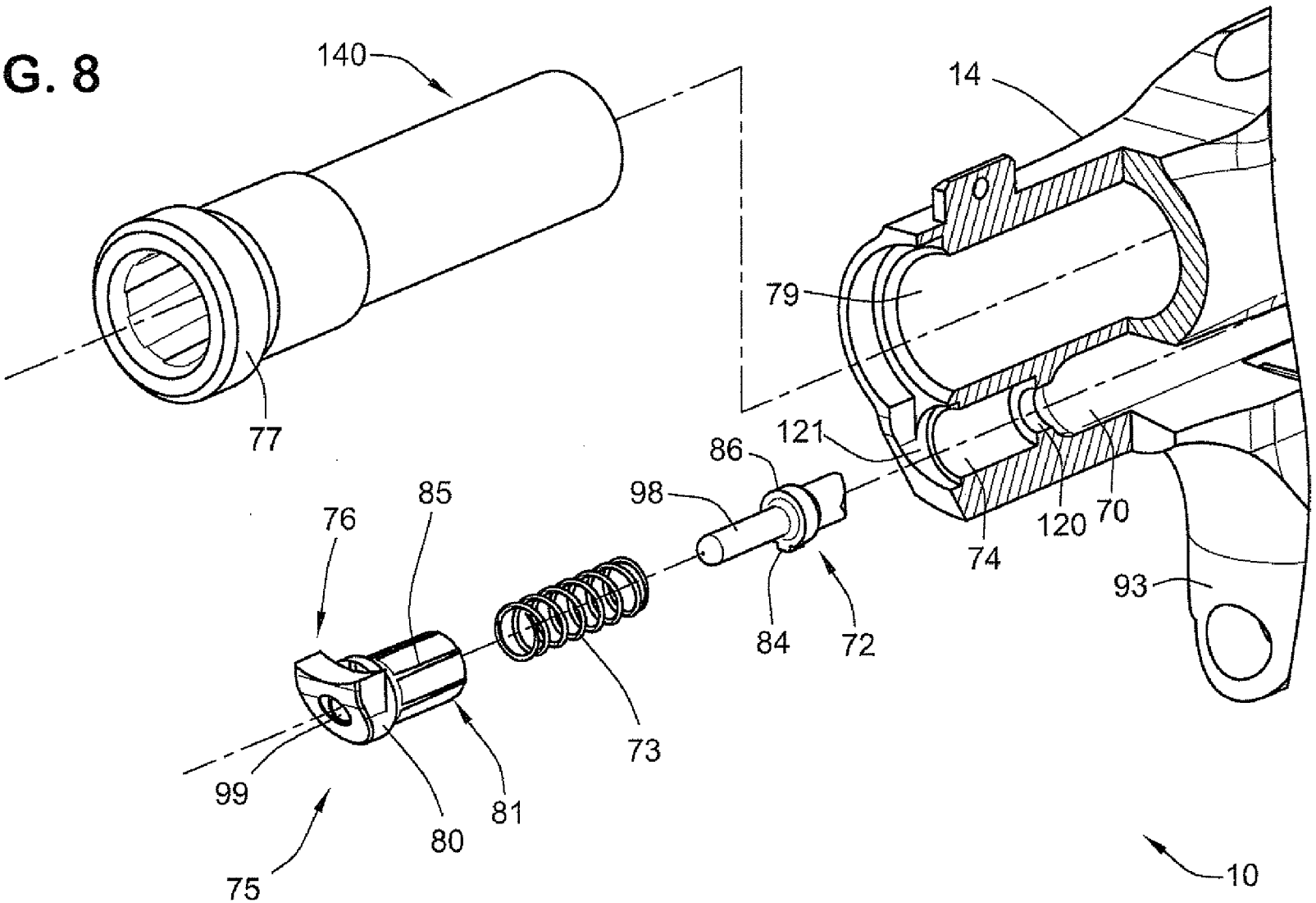
FIG. 8 is a rearward-looking exploded perspective view of the barrel portion of the revolver of FIG. 1.
Figure 9:
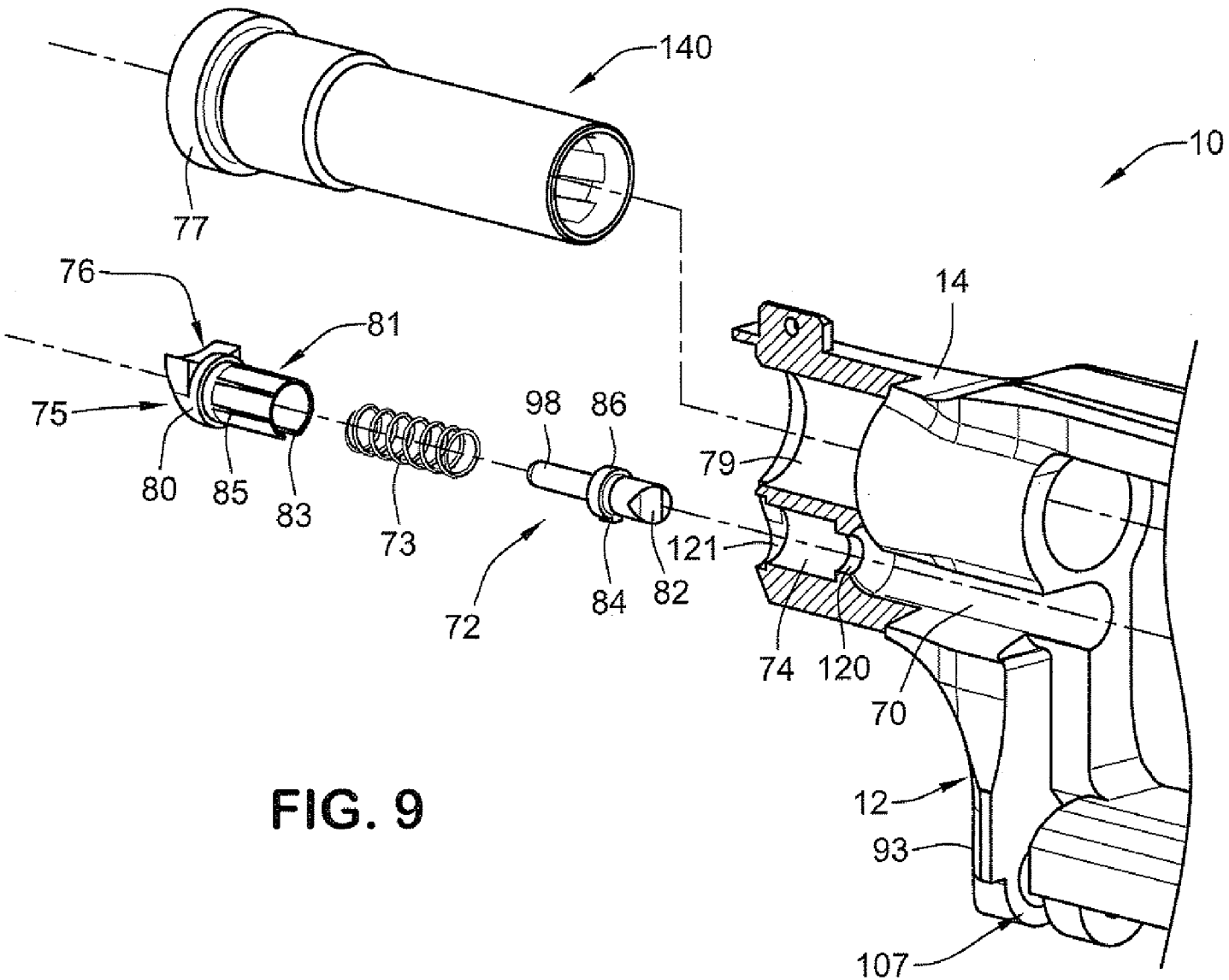
FIG. 9 is a forward-looking exploded perspective view of the barrel portion of the revolver of FIG. 1.
Figure 10:
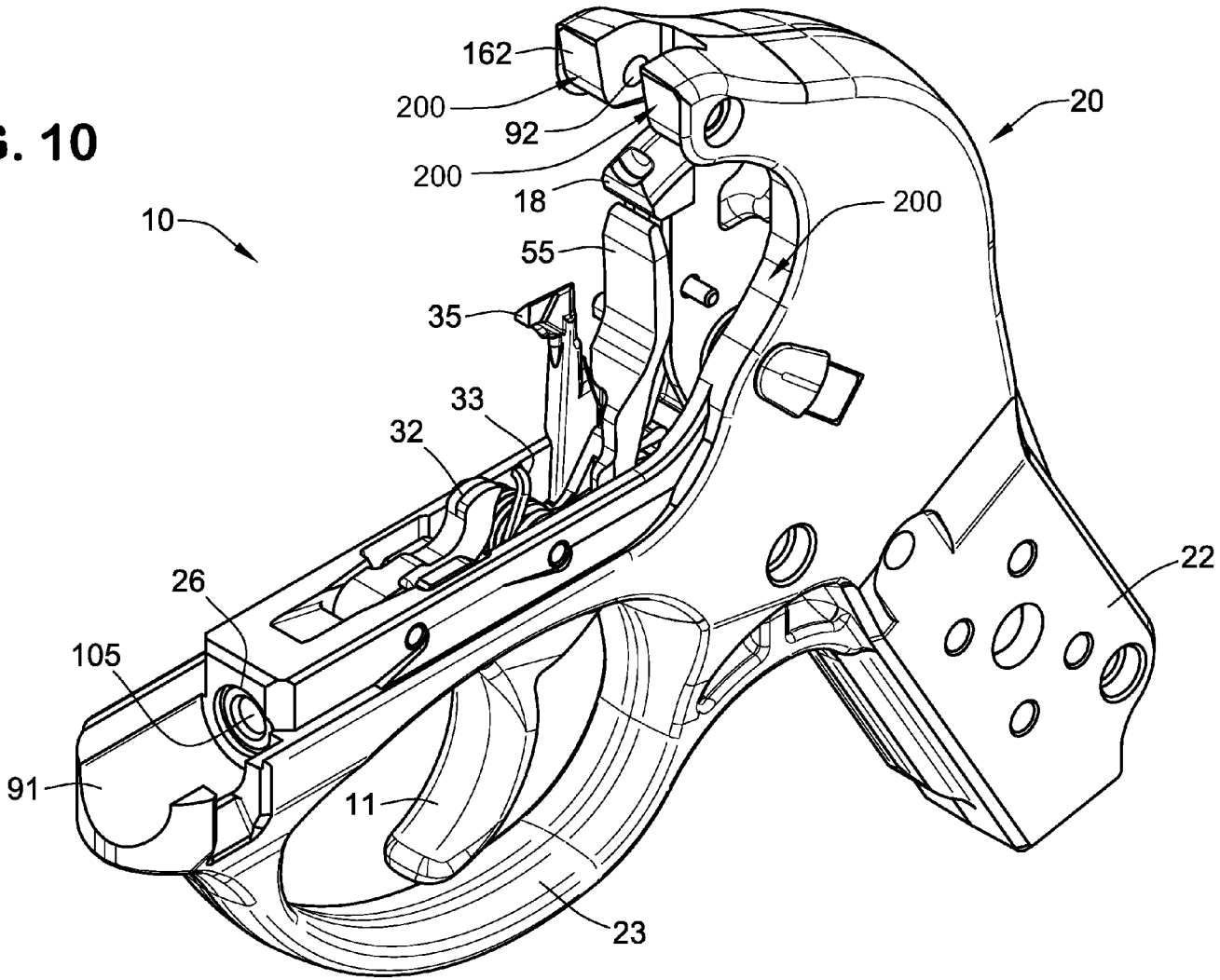
FIG. 10 is left side perspective view of the firing control housing of the revolver of FIG. 1 with firing control components mounted therein.

FIGS. 7-9 show one embodiment of a cylinder crane latching system including a latching member such as plunger 72, biasing spring 73, and retaining plug 75. As best shown in FIGS. 8 and 9, retaining plug 75 includes an enlarged front head 80 with hole therein to allow a portion of plunger 72 such as stem 98 to be projected therethrough and a generally cylindrical rear sleeve 81 that is inserted into a cavity 74 formed in cylinder frame 12. At least a portion of plunger 72 is slidably disposed in cavity 74 of cylinder frame 12 as shown, which also houses spring 73. In one embodiment, spring 73 is a helical compression spring. Preferably, a portion of plunger 72 and spring 73 are disposed in sleeve 81 of retaining plug 75. Plunger 72 includes a generally cylindrical rear projection 87 that preferably extends rearwards at least partially into recess 70 through a rear opening 120 in cavity 74 as shown and is slidably received in an axial opening 108 in the tip of end cap 71 such that the plunger contacts and biases cylinder center pin rod 62 rearwards. The rear of rod 62 is acted upon by cylinder release latch 61 (see FIGS. 1 and 10) which axially moves the rod against the force of spring 73 when actuated.

A front portion of plunger 72 in one embodiment includes a stem 98 that is slidably received in a forward aperture 99 of retaining plug 75. Stem 98 helps guide plunger 72 when spring 73 is compressed and the plunger is moved forward as described herein, thereby projecting a portion of stem 98 through aperture 99. The interaction of stem 98 and aperture 99 adds stability to axial movement of plunger 72 in cavity 74. In one embodiment, plunger 72 includes a flanged portion 86 that engages a portion of cylinder frame 12 surrounding rear opening 120 adjacent to cavity 74 to prevent the plunger from being ejected rearwards through the cavity by spring 73. Preferably, flanged portion 86 is larger in diameter than rear opening 120. In one embodiment, front opening 121 of cavity 74 has a larger diameter than rear opening 120 and at least a slightly larger diameter than flanged portion 86 to allow plunger 72 to be inserted into cavity 74 from the front. Cavity 74 preferably is bored, drilled, or otherwise formed in cylinder frame 12 from the front since the tooling necessary to produce the cavity is generally not accessible from the rear of the cylinder frame, which in a preferred embodiment has a generally solid structure at the rear except for two small holes for the firing pin 60 and center pin rod 62 (see FIG. 6).

With reference to FIGS. 7-10, when the user wishes to reload revolver 10, cylinder release latch 61 is depressed which engages the rear of center pin rod 62 and moves the rod forward against spring-loaded plunger 72, which preferably is in contact with the front of the rod as shown. Plunger 72 is forced forward and retracted into cavity 74 while compressing spring 73 (not shown) to a point where cap 71 may be disengaged from the plunger allowing the cylinder 16 to be swung out laterally from cylinder frame 12. After cylinder 16 is swung out and pin rod 62 disengages plunger 72, plunger 72 is free to re-emerge rearwards from cavity 74 into recess 70 under the force of spring 73.

To return cylinder 16 to cylinder frame 12, the user pushes the cylinder back into the frame. Cap 71 engages plunger 72 forcing the plunger back again into cavity 74 until the hole in the end of the cap becomes concentrically aligned with the plunger which then re-enters the cap and returns to the position shown in FIG. 7 before release latch 61 was actuated. To facilitate smooth engagement and movement between cap 71 and plunger 72, the rear portion of the plunger such as rear projection 87 is preferably shaped with a biased surface 82 that engages cap 71 which preferably is cylindrically-shaped. In one embodiment, forward end of cap 71 may also preferably be rounded as shown to facilitate smooth engagement with plunger 72. In one embodiment, biased surface 82 of plunger 72 may be retained in the orientation shown by providing a longitudinal slot 83 in the bottom of plunger sleeve 81 which is adapted and configured to slidably receive a lug 84 on the bottom of the plunger.

As best shown in FIGS. 7-10, plunger 72 and retaining plug 75 may be retained in cylinder frame 12 in a preferred embodiment without the use of a cross-pin and complex arrangements as used in some conventional revolver designs. Head 80 of retaining plug 75 may be configured with a stepped portion 76 which is engaged by a radially-enlarged flange or boss 77 on the front of barrel insert 140. Preferably, barrel insert 140 may have an internal rifled surface and external threads that engage complementary internal threads in barrel mounting bore 79 in barrel 14 of cylinder frame 12. When barrel insert 140 is threaded into cylinder frame 12, stepped portion 76 of retaining plug 75 is engaged by and trapped behind boss 77 of barrel insert 140 via surface-to-surface contact, thereby locking the end cap 71 to revolver 10. Advantageously, this provides a mechanically simple means for securing retaining plug 75 in revolver 10 without the use of pins. The front horizontal part of stepped portion 76 of retaining plug 75 preferably may be arcuately shaped as shown to mate with the cylindrical contour of boss 77 which rests thereon. This also helps maintain retaining plug 75 in the position shown so that slot 83 in sleeve 81 remains on bottom to in turn maintain biased surface 82 of plunger 72 in a vertical position via sliding engagement of bottom lug 84 with the slot.

The foregoing cylinder lock system advantageously is mechanically simple, reliable, and accomplished in fewer parts than some convention revolver designs that reduces production costs in both materials and assembly labor. The cylinder latching system also has economic advantage, as the cap 71 and/or retaining plug 75 may be produced from either metal or non-metallic materials, and may be produced either by metal injection molding (MIM) or via injection molding of a polymer.

A preferred method of assembling the cylinder latching system will now be described with reference to FIGS. 7-9. The method includes inserting plunger 72 into cavity 74 of cylinder frame 12. Preferably, plunger 72 is inserted into cavity 74 from the front of cylinder frame 12 through front opening 121. Plunger 72 is preferably oriented so that biased surface 82 faces the left side of pistol 10 (as shown in FIG. 9) and lug 84 is on the bottom to be subsequently received by slot 83 in sleeve 81. Next, spring 73 is inserted into cavity 74 and engaged with plunger flanged portion 86 forcing the plunger rearwards and extending rear projection 87 through rear opening 120 of the cavity (if not already extended therethrough). Flanged portion 86 of plunger 72 engages a portion of cylinder frame 12 surrounding opening 120. Retaining plug 75 is then inserted into cavity 74 with sleeve 81 being first received in the cavity. Preferably, slot 83 in sleeve 81 is slidably engaged with lug 84 of plunger 72. Stepped portion 76 of retaining plug 75 engages a complementary-shaped portion of cylinder frame 12 and becomes seated in the frame. Barrel insert 140 is then rotationally inserted into barrel 14 engaging the external threads on the insert with the internal threads 79 formed on the barrel. Stepped portion 76 is engaged by a radially-enlarged flange or boss 77 on the front of barrel insert 140, thereby trapping and locking retaining plug 75 in cylinder frame 12.

In another alternative embodiment, spring 73 may be inserted into sleeve 81 of retaining plug 75 followed by inserting plunger 72 into the retaining plug behind the spring. Slot 83 in sleeve 81 is preferably slidably engaged with lug 84 of plunger 72. The retaining plug-plunger assembly 75, 72 may then be inserted into cavity 74 of cylinder frame 12 in the position shown in FIGS. 7-9. This is followed by threadably inserting barrel insert 140 into barrel 40 as described above, and trapping retaining plug 75 in the cylinder frame with the barrel insert.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

The invention claimed is:

1. A revolver with separable light-weight firing control housing comprising:

a cylinder frame supporting a rotatable cylinder defining a plurality of cartridge-receiving chambers, the cylinder being received in a complementary configured opening defined by the cylinder frame;

a separable firing control housing made of a non-metallic material and removably attached to the cylinder frame to form a stationary fixed connection, the firing control housing supporting at least one firing control mechanism component for discharging the revolver; and a spaced pair of forwardly extending projections disposed on the firing control housing that receive therebetween a rearwardly extending projection disposed on the cylinder frame, the forwardly extending projections each defining a firing control housing bearing surface that engages the cylinder frame for absorbing recoil forces from discharging the revolver.

2. The revolver of claim 1, wherein the cylinder frame is made of a metallic material.

3. The revolver of claim 1, wherein the firing control housing is made of a polymer.

4. The revolver of claim 1, the firing control housing includes an integral grip tang configured for mounting a hand grip thereto.

5. The revolver of claim 1, wherein the firing control housing includes a forward portion having a threaded metallic insert for receiving a complementary threaded retaining pin that pivotably mounts a cylinder crane to the revolver for rotationally supporting the cylinder, the retaining pin being operably engaged with a swing arm of the cylinder crane and a lower lobed portion of the cylinder frame extending below the cylinder, the retaining pin attaching the cylinder frame and swing arm to the forward portion of the firing control housing.

6. The revolver of claim 1, wherein the firing control housing further defines an arcuately-shaped internal cavity that houses the hammer for pivotable movement.

7. The revolver of claim 6, wherein the firing control housing has a rounded top profile that complements the shape of the arcuately-shaped internal cavity.

8. The revolver of claim 1, wherein the firing control housing includes an integral trigger guard.

9. The revolver of claim 1, wherein the firing control housing is formed by injection molding.

10. The revolver of claim 1, wherein the at least one firing control mechanism component is a pivotable hammer actuated by a trigger.

11. The revolver of claim 10, wherein both the pivotable hammer and the trigger are pivotably mounted to the firing control housing.

12. A revolver with separable light-weight firing control housing comprising:

a metal cylinder frame defining an opening receiving a rotatable cylinder, the cylinder rotatably supported in the opening by the cylinder frame and defining a plurality of cartridge-receiving chambers;

a separable firing control housing supporting the cylinder frame, the firing control housing being made of a non-metallic material and including an integral rear grip tang for mounting a hand grip and a forward portion for removably mounting the cylinder frame to the firing control housing to form a stationary fixed connection;

a trigger pivotably mounted to the firing control housing;

a spring-biased hammer pivotably mounted to the firing control housing, the hammer being movable to a cocked position by the trigger;

a spaced pair of forwardly extending projections disposed on the firing control housing that receive therebetween a rearwardly extending projection disposed on the cylinder frame, the forwardly extending projections each defining a firing control housing bearing surface that engages the cylinder frame for absorbing recoil forces from discharging the revolver; and a pair of spaced generally concave shaped bearing surfaces disposed on the firing control housing below the pair of projections that engage a pair of spaced and mating complementary configured convex shaped bearing surfaces disposed on the rear of the cylinder frame.

13. The revolver of claim 12, wherein the hammer is completely enclosed in an internal cavity defined by the firing control housing.

14. The revolver of claim 12, wherein the firing control housing defines an arcuately-shaped cavity that houses the hammer and the firing control housing has a complementary-shaped rounded top profile to prevent snagging the revolver on a user's clothing.

15. The revolver of claim 12, further comprising a mainspring strut supported by the grip tang of the firing control housing.

16. The revolver of claim 12, wherein the cylinder frame is coupled to the firing control housing by a retaining pin received through a hole in a lower portion of the cylinder frame, the retaining pin engaging a metallic insert disposed in the forward portion of the firing control housing.

17. The revolver of claim 12, wherein the hammer is pivotable to contact a slidable firing pin supported by the cylinder frame.

18. The revolver of claim 12, wherein the firing control housing is made of a polymer.

19. A method of assembling a revolver having a separable light-weight firing control housing comprising:

providing a non-metallic firing control housing;

mounting a trigger to the housing;

mounting a hammer to the housing for pivotable movement between a cocked and an uncocked position;

securing a metallic cylinder frame to the housing to form a stationary fixed connection, the cylinder frame defining an opening and rotatably supporting a cylinder in the opening that defines a plurality of cartridge-receiving chambers;

inserting a projection disposed on the rear of the cylinder frame between a pair of spaced apart forwardly extending projections disposed on the firing control housing; and engaging bearing surfaces defined by the pair of projections on the firing control housing with mating bearing surfaces on the cylinder frame for absorbing recoil forces from discharging the revolver.

20. The method of claim 19, wherein the securing step includes longitudinally inserting a retaining pin through a hole in the cylinder frame and engaging the retaining pin with the firing control housing.

21. The method of claim 20, wherein the engaging step includes engaging a threaded portion of the retaining pin with a threaded metallic insert disposed in the firing control housing.

22. The method of claim 19, further comprising placing a cylinder crane with the cylinder rotatable mounted thereon into the cylinder frame, and wherein the securing step including longitudinally inserting a retaining pin through a hole in the cylinder frame and an aperture in the cylinder crane to secure the cylinder frame and the cylinder crane to the firing control housing.

23. The method of claim 22, wherein the retaining pin threadably engages a metallic insert disposed in the firing control housing.

24. The method of claim 19, wherein the firing control housing is made of a polymer.

25. The method of claim 19, further comprising a step of engaging a pair of spaced generally concave shaped bearing surfaces disposed on the firing control housing below the pair of projections with a pair of spaced and mating complementary configured convex shaped bearing surfaces disposed on the rear of the cylinder frame.

26. The method of claim 19, further comprising a step of laterally inserting a pin through the pair of spaced projections on the firing control housing and projection disposed on the rear of the cylinder frame.

27. The revolver of claim 1, further comprising a pin laterally inserted through the pair of spaced projections on the firing control housing and the projection on the cylinder frame to form an upper pinned connection securing the frame to the housing.

28. The revolver of claim 1, further comprising a firing pin axially aligned with an uppermost chamber defined by the cylinder, at least part of bearing surfaces defined by the spaced pair of projections on the firing control housing extending above the firing pin.

29. The revolver of claim 28, wherein the pair of projections on the firing control housing extend over and forward of a rear end portion of the cylinder frame that is axially aligned with a central hub of the cylinder for mounting the cylinder to the cylinder frame.

30. The revolver of claim 12, wherein the bearing surfaces on the pair of spaced projections on the firing control housing are forward facing and engage mating rearward facing bearing surfaces on the rear of the cylinder frame.

31. The revolver of claim 12, wherein the bearing surfaces on the pair of spaced projections on the firing control housing are positioned forward of the concave shaped bearing surfaces on the firing control housing.

32. The revolver of claim 31, wherein the bearing surfaces on the pair of spaced projections on the firing control housing extend downward and rearward each forming one of the respective concave shaped bearing surfaces on the firing control housing.

* * * * *